United States Patent [19]

Sweeney et al.

[11] 3,969,556

[45] July 13, 1976

[54] WHIPPED WAX BASE DISPLAY

[76] Inventors: Doris Sweeney, 512 A Taylor Ave., Warrington, Pa. 18476; Mary Ellen Lee, 7951 Anita Drive, Philadelphia, Pa. 19111

[22] Filed: Jan. 2, 1975

[21] Appl. No.: 537,968

[52] U.S. Cl. ..... 428/13; 428/484; 428/542; 431/291

[51] Int. Cl.[2] ..... B44C 3/04

[58] Field of Search ..... 161/8, 18, 19, 20, 234; 240/10 B, 10 D, 10 R, 13; 431/125, 126, 288, 289, 291; 425/803; 427/416, 443; 428/3, 13–16, 484, 542, 310, 323, 409; 156/61, 63

[56] References Cited

UNITED STATES PATENTS

| | | | |
|---|---|---|---|
| 664,246 | 12/1900 | Ellis | 431/289 |
| 2,234,903 | 3/1941 | Muench | 431/126 X |
| 2,380,126 | 7/1945 | Sturm | 260/738 |
| 2,974,509 | 3/1961 | Penke | 431/288 X |
| 3,020,811 | 2/1962 | Lincoln et al. | 161/38 X |
| 3,144,730 | 8/1964 | Johnson | 161/18 X |
| 3,654,046 | 4/1972 | Crane | 161/18 X |
| 3,744,956 | 7/1973 | Hess | 431/126 |
| 3,744,957 | 7/1973 | Wright, Sr. | 431/126 |
| 3,772,421 | 11/1973 | Costich | 161/234 X |
| 3,806,723 | 4/1974 | Ollom | 431/289 X |

*Primary Examiner*—Marion E. McCamish
*Assistant Examiner*—Henry F. Epstein
*Attorney, Agent, or Firm*—Joseph W. Molasky

[57] ABSTRACT

A display consisting essentially of: (1) a transparent container, such as a bowl, within which is placed (2) a whipped wax in solid form, the surface of which is irregular but which otherwise conforms to the contours of said container and into which is impressed (3) various objects so as to afford a visually pleasing scene.

7 Claims, No Drawings

WHIPPED WAX BASE DISPLAY

This invention relates to a visual display and to a method for preparing same.

Specifically, this invention relates to a visual display consisting of a transparent container or vessel into which a whipped molten wax has been poured and which is characterized by various objects which have been impressed into its surface so as to create a scene or other visually pleasing effect.

BACKGROUND

It is well-known in the display art to use wax as a base-material for creating scenes in miniature. White colored waxes, in particular, have been used to provide a foundation or support for miniature winter displays because their white appearance give the effect of new-fallen snow. Also, because of their ability to remain in a semi-solid state when subjected to heat, most waxes lend themselves to being 'worked', that is, the surface of the wax can be suitably shaped or various objects can be impressed into its surface so as to create a desired scenic effect.

The disadvantage to creating a wax display by the aforementioned means lies in the tendency of molten wax to even-out and then harden to a relatively smooth surface. This attribute is a distinct detriment in creating snow scenes because winter landscapes are generally characterized by an uneven surface and exhibit a granular effect which is attributable to the crystalline character of snow. Heretofore it has been impossible to obtain such an effect using known methods. This is particularly true in the case of winter scenes. The irregular pattern and effects of drifting snow is virtually impossible to achieve using molten wax per se.

One additional drawback to known wax displays and particularly those depicting winter scenes, is the fact that when molten wax hardens it does not afford a white color truly representative of new-fallen snow. Therefore, to achieve a truly white appearance, it is usually necessary to add to the melted wax a color additive or pigment in order to impart the desired degree of whiteness.

THE INVENTION

According to this invention, it is now possible to create a visual display consisting of a wax base characterized by a surface which is more nearly similar to real snow and which does not necessarily require the addition of whiteners to achieve a snowlike appearance.

Specifically this invention consists of a visual display comprising:

1. A transparent container which contains
2. a whipped wax shaped to the contours of said container, the surface of which has an uneven appearance and into which has been set
3. one or more objects for the purpose of creating a scene or other visually pleasing effect.

More specifically, this invention consists of a visual display comprising:

1. A transparent bowl containing
2. a whipped wax in solid form, the surface of which is irregular but which otherwise conforms to the contours of said bowl and whose surface is impressed
3. with various objects so as to afford a scene in miniature.

This invention is particularly suitable for preparing winter scene displays where a truly white appearancce in the wax base is desired and where, in addition, it is desirable to provide an uneven surface resembling the appearance of new fallen and drifting snow.

The display of this invention can be assembled in any transparent container as, for example, in a bowl, jar or any other receptacle through which the said display can be viewed. The container may be constructed of glass or plastic but in either case it must be sufficiently impervious to heat so that it can withstand the temperature of the molten wax which is poured therein. Also, if desired, the container may be tinted so as to impart a tint or hue to the display which is contained therein.

The essence of this invention lies in the discovery that a more attractive and whiter appearance and an improved texture and gloss can be imparted to a wax solid by dispersing air into the said wax in its molten state and beating it over a protracted period of time so as to uniformly distribute the air through the mixture. The molten wax is then poured into an appropriate container until the desired level of wax is reached. The amount of wax employed in erecting a display is not critical but, in general, it is preferred to bring the level of the wax up to about one-third or one-half the height of the container so as to allow sufficient space for inserting the objects of the display into the still-soft wax.

The resulting package is a container which is only partially filled with a wax having a whipped, fleecy or flocculent appearance and which is most pleasant to behold. At this juncture, while the wax is still soft various objects are impressed into its surface so as to create the desired scenic effect. The resulting display is most attractive. When the wax hardens, the scene becomes immobile and as a practical matter, it is so firmly set that even if the container is turned upside down the entire scene will remain in place. This is a distinct advantage from a commerical standpoint because it is thus possible to ship the instant displays without disturbing them so that they arrive at their destination in exactly or substantially the same condition as when they were first made.

An optional feature of this invention consists of adding sand or similar abrasive to the melted wax so as to modify the texture of the congealed mass. The resulting display is an off-white wax base which is an attractive counterpoint to the glossy, smooth textured base which is obtained absent the abrasive ingredient. The surface is somewhat gritty to the touch but it otherwise remains the whipped and irregular effect which is characteristic of the instant wax base.

The wax which is employed in this invention is a mixture of solid hydrocarbons obtained from petroleum but, preferably, a paraffin wax. Paraffin is generally colorless or white in appearance. It is somewhat translucent, odorless and has a greasy feel.

In practice, the wax base which is used in this display is prepared batchwise by placing it in a container where it is heated to a temperature in excess of its melting point. When the wax has melted completely, the resulting mass is beaten with an electric-powered mixer over a protracted period so as to aerate the mixture and thus disperse as much atmospheric gas into the molten wax as is possible.

The amount of air which is injected into the molten paraffin is not particularly critical and, in general, it is sufficient if the air displaces at least about 10% by weight of the paraffin. However, in practice, it is preferred that amounts of gas be dispersed in the paraffin sufficient to displace from about 12% to about 20% by weight of the paraffin. By incorporating such quantities of air into the paraffin there is obtained a wax which has an improved appearance, gloss and consistency. The paraffin has a creamy, whipped-like appearance and thus is in a form which is especially suitable for use in the visual display of this invention.

When the air is injected into the container, it is essential that the paraffin be in a melted state. If the parrafin is not sufficiently melted, the air will not be entrapped within the wax. On the other hand, if the temperature of the paraffin is maintained at too high a level it will drive off the air bubbles contained therein and thus fail to provide a properly aerated mixture. Suitable temperatures are in the range of from about 122°–175° F., preferably, 125°–170° F. and, most preferably, 155°–165° F.

The following example illustrates a continuous process for preparing the wax which is employed as the base in the instant display.

EXAMPLE

Paraffin wax is placed in a thermostatically controlled container and heated to a temperature of 155° F.

The melted paraffin is then pumped into a second container of similar construction where the temperature is maintained at abut 145° F. and which contains blades rotating at about 500 to 700 rpm. At this juncture a perfume, dye, sand or stabilizer may be added to the melted paraffin so as to effect a complete dispersal of the additive.

Air which is maintained at substantially ambient temperature is then injected into the second container by means of a sparger tube. The temperature of the melted paraffin is lowered somewhat as a result of the addition of the ambient air and, therefore, heat is applied so as to maintain the temperature of the mixture at about 100° F. while also maintaining the rpm of the beater blades at about 550 to 650 rpm.

The heated paraffin with the air dispersed therein is then fed directly from the second container into a fill-up chamber from which it is fed into transparent containers which are preheated to a temperature of about 100° F. The wax has a fluocculent or whipped appearance and has a truly white color.

The containers filled with the heated paraffin are then set aside where they are allowed to come to ambient temperature.

Prior to setting, various objects are pressed into the wax so as to create the desired scenic effect. In one embodiment a winter scene is created by impressing a miniature house, artificial trees made to scale and parts of live tree branches including shrubs and/or pieces of evergreen such as pine or spruce and the like, into the soft wax. Also, the aesthetic appearance and life-like quality of the display can be enhanced by laying out miniature paths on the surface of the wax so as to simulate real life scenes. This is accomplished by impressing suitably colored marble chips or colored pebbles and the like into the soft wax surface in either a planned or random fashion. The resulting display is most attractive. The flocculent appearance of the wax gives the snow scene a quality which borders on a real-life effect. This effect is further enhanced by the resplendent whiteness of the wax. Its color is a pure white and distinctively unlike the appearance usually associated with naturally occurring or unwhipped paraffin.

The foregoing example illustrates a method for preparing a winter scene display; however, it is to be understood that this invention is not so limited. Thus this invention can be used to create displays for all seasons as, for example, Easter displays or Mother's Day scenes and other occasional displays where a frothy or flocculent appearance in the wax base is desirable.

As indicated above, this invention has particular application in preparing wax-base displays where a pure white color in the said base is desirable or critical. However, according to still another embodiment of this invention, the wax may be tinted to any desired color by simply incorporating a color additive or pigment into the melted wax during the beating step.

What is claimed is:

1. A visual display comprising:

1. a transparent container in which is
2. a solid whipped wax mold shaped to the contours of said container, the surface of which has a whipped appearance and into which has been set
3. one or more objects for the purpose of creating a visually pleasing effect.

2. The display of claim 1 which comprises:

1. a transparent bowl containing
2. a whipped wax in solid form the surface of which is irregular but which otherwise conforms to the contours of said bowl and whose surface is impressed
3. with various objects so as to afford a scene in miniature.

3. The display of claim 2 wherein the whipped wax has a white color and the scene is a winter scene.

4. The display of claim 2 wherein the whipped wax is a paraffin wax.

5. The display of claim 4 wherein the whipped paraffin wax contains from about 10% to about 20% by weight of air.

6. The display of claim 2 wherein the whipped wax contains finely divided sand particles.

7. The display of claim 2 wherein the whipped wax contains a whitener.

* * * * *